US005367812A

United States Patent [19]

Lautrec

[11] Patent Number: 5,367,812

[45] Date of Patent: Nov. 29, 1994

[54] GUN STOCK EXTENDER FOR A RIFLE

[76] Inventor: Peter Lautrec, Box 174, Baldwin, Wis. 54002

[21] Appl. No.: 82,886

[22] Filed: Jun. 28, 1993

[51] Int. Cl.[5] ..... F41C 23/08; F41C 23/14

[52] U.S. Cl. ..... 42/74; 42/73; 42/72

[58] Field of Search ..... 42/73, 74, 72, 71.01

[56] References Cited

U.S. PATENT DOCUMENTS

| | | | |
|---|---|---|---|
| 1,255,566 | 2/1918 | Pearson | 42/73 |
| 1,964,649 | 6/1934 | Stetson | 42/74 |
| 3,039,222 | 6/1962 | Hoge | 42/74 |
| 3,707,797 | 1/1973 | Ruth | 42/74 |

FOREIGN PATENT DOCUMENTS

| | | | |
|---|---|---|---|
| 1536355 | 7/1968 | France | 42/73 |
| 1536354 | 8/1968 | France | 42/71.01 |
| 8519 | 2/1879 | Germany | 42/74 |
| 2231543 | 1/1974 | Germany | 42/74 |
| 3812815 | 11/1989 | Germany | 42/73 |

*Primary Examiner*—Stephen M. Johnson
*Attorney, Agent, or Firm*—Leo Gregory

[57] ABSTRACT

A butt stock extender for a rifle to avoid the impact of recoil on an adjacent head portion of the operator.

3 Claims, 2 Drawing Sheets

GUN STOCK EXTENDER FOR A RIFLE

BACKGROUND OF THE INVENTION

1. Field of the invention

This invention relates to a modification of the butt end of a gun stock to provide an extension for the same.

2. Description Of the Previous Art

A rifle when held in firing position has the butt end portion of the gun stock in close proximity with the nose of thee person holding the same and some rifles which have a substantial recoil result in the rifle butt stock portion close to the face of the operator being thrust against the face of the operator and most generally into the protrusion of the nose, frequently the thrust of the recoil is sufficient to cause damage to the nose.

The recoil is particularly strong in the higher powered rifles such as a Gatand or an M14 rifle. There is no known buffer in use to alleviate this condition and avoid the risk of facial damage in firing a rifle.

It is desirable therefore to provide means which could become a part of a rifle and remove the risk of damage from recoil in the operation of a rifle.

SUMMARY OF THE INVENTION

It is an object of this invention to provide an attachment for the butt end portion of the gun stock of a rifle which would avoid any contact of said gun stock portion with the face of the operator in reacting to the recoil of the rifle upon its being fired.

It is a further object of the invention herein to provide an adjustable extension to be mounted in and carried by the butt portion of the gun stock of a rifle .

Some rifles, such as the well known Garand or the M14 have hinged butt plates and a pair of bores extending inwardly thereof which can very conveniently accommodate the arrangement provided for herein .

These and other objects and advantages will be set forth in the following description made in connection with the accompanying drawings in which like reference characters refer to similar parts throughout the several views.

DESCRIPTION OF A PREFERRED EMBODIMENT

Figures 1, 2, 3, 4:
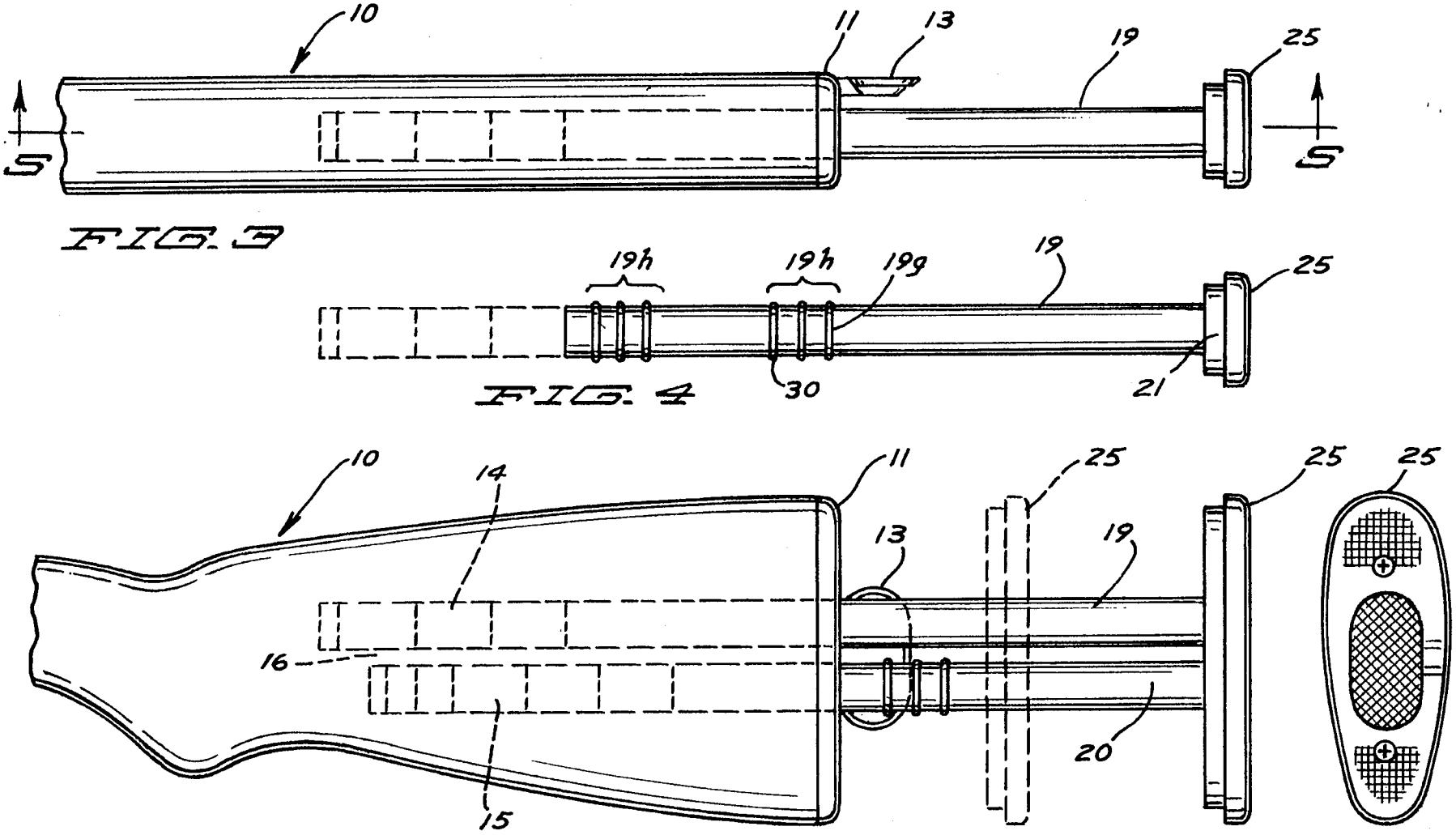
FIG. 1 is a broken view in front elevation of a gun stock showing an extension thereof partially in dotted line.
FIG. 2 is a view in end elevation showing a butt plate.
FIG. 3 is a top plan view corresponding to that of FIG. 1.
FIG. 4 is a top plan view showing an extension member with an extension thereof in dotted line.
Figures 5, 6, 7, 8:
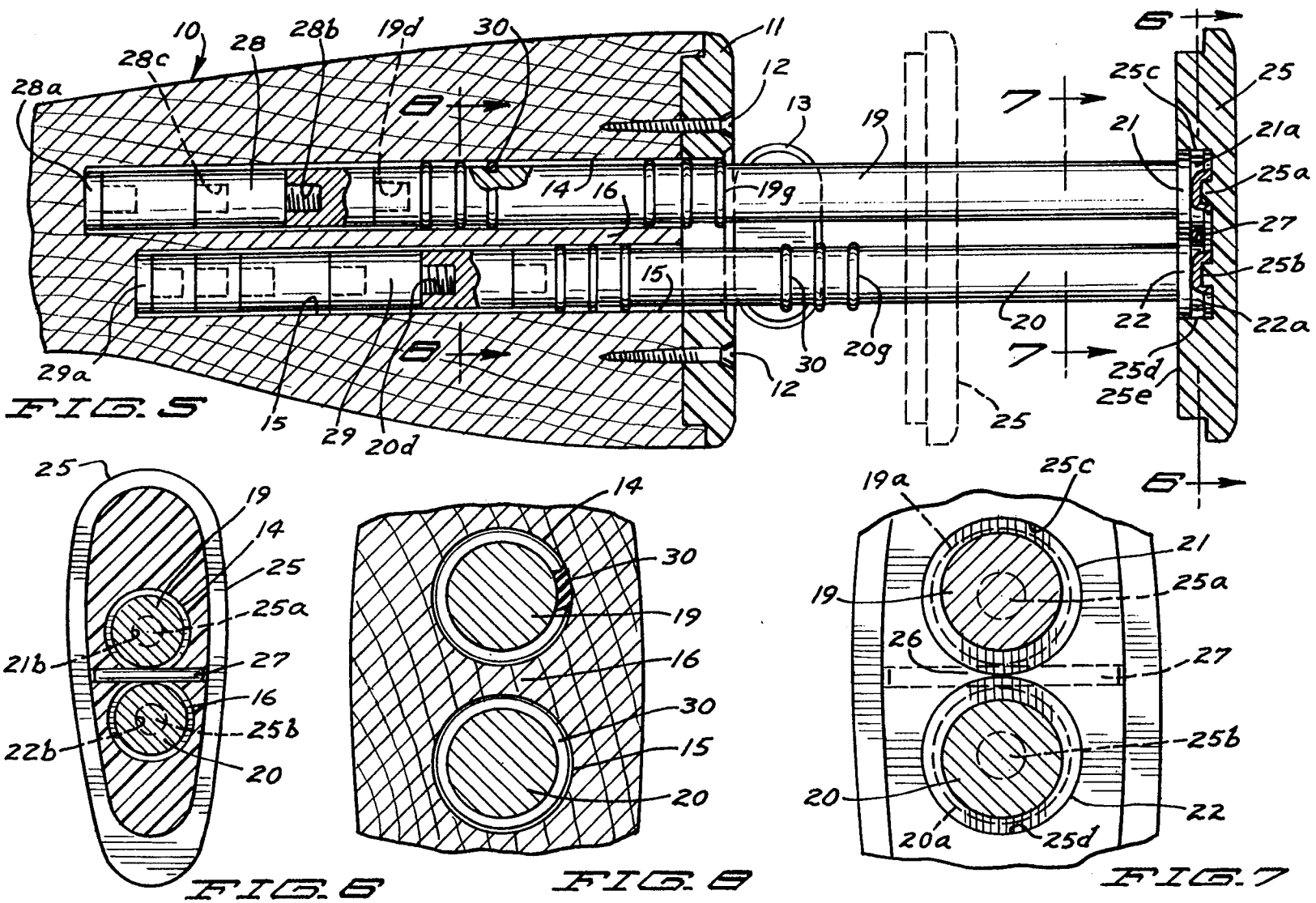
FIG. 5 is a view partially in vertical section showing a maximum extension thereof in section and a minimum extension in dotted line.
FIG. 6 is a view in section taken on line 6—6 of FIG. 5 as indicated.
FIG. 7 is a broken view partially in section taken on line 7—7 of FIG. 5 as indicated.
FIG. 8 is a broken view in section taken on line 8—8 of FIG. 5 as indicated.

Referring to FIGS. 1 and 5 , a broken view in side elevation is shown of a gun stock 10 of a rifle. Although the gun stock or stock illustrated is representative of that of a Garand or M14 rifle, the invention herein as described may apply generally to all rifles modified for its use. The Garand and M14 rifles require no modification, the same having inward extending bores in their stocks as will be described.

Overlying the rear or right hand end of said stock as seen in FIG. 5 is a butt plate or plate 11 secured by screws 12 and inset or recessed therein to be flush therewith is a hinged cover plate 13 which ordinarily overlies two bores 14 and 15 extending inwardly of said stock having therebetween for separation a web 16 . As shown, said bores are not necessarily of the same length or depth as shown, the bore 14 being shown as the longer of the two bores .

For normal or usual purposes , the said bores are provided for storage space to receive tools and other related items used to maintain and service the rifle but the bores are utilized for the purpose of the invention herein as will be described. Thus , as indicated, there is no modification required of a Garand or M14 rifle for the attachment of the invention thereto. For use of the invention herein in connection with other rifles which do not have bored stocks , the same would have to be bored as here shown.

In the normal positioning of a rifle in aiming the same, the butt stock portion in being cradled in the shoulder of the operator is held so close to the forward face portion of the operator, that it is not unusual for the impact of the recoil of the firing of the rifle to reach and jar the face of the operator and frequently impact the face of the operator to cause damage particularly to the nose structure as that is the most outward projecting portion of the face. As will be described, the addition to the rifle stock of the invention herein provides on the order of at least one and five-eights to one and three-quarter inches distance away from the face of the operator while in no way adversely affecting the positioning and aiming or stance of the rifle. This additional spacing has been found to be sufficient to avoid the stock portion of a rifle from impacting the face of the operator.

As has been stated, the bores 14 and 15 are present in Garand and M14 rifles. Access to the bores is readily had by pulling open a hinged inset butt plate cover 13.

Adapted to be disposed into said bores are a pair of cylindrical shafts 19 and 20 which are hereafter referred to as dowels , the dowel 19 being shown here as being the longer of the two. Said dowels will have a diameter to readily fit into said bores and the lengths are adapted to correspond to the depths of the bores as they are generally formed as here shown in. The dowels may be used with or without spacer extensions as will be further described and for purpose of illustration are shown with spacers added in FIG. 5 and these will be described.

The dowels in being positioned alongside one another in substantially parallel relationship are spaced apart to accomodate the web 16 between the bores . Said webs may vary in width or thickness from one rifle to another and thus the spacing between the dowels is also adapted to vary, as will be described.

Said dowels respectively have diametrically enlarged lower end or butt plate engaging portions 21 and 22 , the same respectively having annular grooves **21*a* and 22*a*** thereabout.

Referring to FIG. 6 , said lower end portions of said dowels respectively have axial bores **21*b* and 22*b* which are seated upon the upward projecting bosses 25*a* and 25*b* of a butt plate 25** which is a replica of the butt plate 11, said bosses being axially positioned in the respective bores 25c and 25d of the inner side portion 25e of said butt plate 25, said bores having a web 26 therebetween and said bores having diameters to nicely receive the adjacent end portions 21 and 22 of said dowels.

Said dowels are respectively eccentrically positioned upon their lower butt plate engaging end portions as noted particularly in FIG. 7 wherein the butt plate bores are seen at 25c and 25d. The lower end dowel portions are seen at 21 and 22 and the dowels 19 and 20 are seen to bottom upon said respective end portions at the dotted circles indicated at 19a and 20a. The eccentricity of the dowels 19 and 20 to their respective bottom end portions 21 and 22 by reference to the butt plate bore openings or bores is indicated at 25c and 25d. This will be further described.

It is seen that said bosses 25a and 25b do not have sufficient holding capacity to secure said dowels 19 and 20 in said butt plate 25. To secure the same, a blind roll pin 27 is disposed transversely into said butt plate through the web 26 and said pin will have such a diameter as to extend outwardly of said web sufficiently to have portions thereof extending into and engaging the respective annular grooves 21a and 22a to permit free rotation of said dowels at their bottom end portions yet engage them sufficiently to secure them against withdrawal.

To refer now to the spacers of the dowels into said gun stock bores 14 and 15, the basic dowels have lengths to generally correspond to the depths of the bores present in Garand and M14rifles allowing a minimum extension of said butt plate 25 beyond the rifle stock butt plate 11. The amount of the extensions indicated between the gun stock butt plate 11 and the butt plate 25 in solid line and in dotted line is exaggerated for purpose of illustration. The butt plate 25 in dotted line represents a minimal extension as would occur with the dowels having no spacers added and the butt plate in solid line indicate a spacing from the butt plate 11 with spacers added to the dowels.

The dowels without spacers disposed into said bores 14 and 15, have such lengths as to generally extend the butt plate 25 on the order of one and five-eights inches beyond the gun stock or the gun s rock butt plate 11. This is regarded as a suitable length of pull as this spacing or extension is referred to.

The dowels may be lengthened by the addition of spacers and there are two reasons for this. One reason is to vary the length of pull to accommodate different preferences of rifle operators and the other is to accommodate different depths of bores into gun stocks.

With particular reference to FIG. 5, the spacers are indicated at 28 and 29. For purpose of illustration, the dowel 19 is shown having three spacers 28 added and the dowel 20 is shown having five spacers added. Said spacers end with end caps 28a and 29a.

The dowels 19 and 20 at their inner ends each have a threaded recess as at 19d and 20d to normally receive end caps. Tile spacers have threaded bosses as at 28b at one end and threaded recesses as at 28c at their other ends. The lengths of the spacers are illustrative but in practice they are conveniently formed to be an inch or fraction thereof in length.

For all reasonable purposes, the range for the extension of the butt plate 25 or length of pull is on the order from one and five-eights ($1\frac{5}{8}$) inches to three and one-fourth ($3\frac{1}{4}$) inches.

The dowels are formed to slide easily into the bores of a gull stock but it is desirable to have them remain therein fairly securely. To this end, annular grooves 19g and 20g are formed about said dowels as shown in FIG. 4 with respect to the dowel 19. As indicated here, said grooves are shown to be spaced in groups of three as at 19h.

Adapted to be disposed into said annular grooves are O-rings 30 each having a ring thickness as to frictionally engage the adjacent wall of the bore thereabout to securely hold said dowels wi thin said bores against falling out of or being jarred out of said bores and requiring a strong pull to withdraw said dowels from being positioned in bores.

Said annular grooves 19g and 20g may be formed having various depths whereby the O-rings thereabout will project outwardly various extents to accommodate various sized bores. Hence here the operator will be selective in fitting 0-rings about those grooves which will provide good frictional engagement for a given sized bore.

Also as has been indicated, the webs between bores may vary in thickness. The dowels in being eccentric to their bases or lower end portions, need only to be rotated to vary the spacing or distance therebetween to accommodate various widths of webs.

Thus it is seen that I have provided a very convenient means for holding a rifle in firing position without having any portion of the gun stock being thrust against the face of the operator in reacting to the recoil of firing a rifle.

It will of course be understood that various changes mabe made in the form, details arrangement and proportions of the invention without departing from the scope of the invention which, generally stated, consists in a product capable of carrying out the objects above set forth, in the parts and combination of parts disclosed and defined in the appended claims.

What is claimed is:

1. A butt extension of a gun stock comprising, the gun stock having a butt end having a pair of bores extending inwardly thereof, a butt plate having a gate therein overlaying said butt end of said gun stock, a pair of cylindrical dowels disposed into said bores and having outer end portions extending outwardly of said butt end and said butt plate, said dowels having diametrically enlarged outward extending end portions, said end portions each having an annular groove thereabout, a second butt plate, a pair of bores on one side of said second butt plate, a web between said second mentioned bores, a boss extending outwardly axillary of each of said second mentioned bores, said enlarged outwardly extending end portions of said dowels each having a bore therein, the bores of each of said dowels being respectively seated upon said bosses, a pin disposed laterally through said second mentioned butt plate and through said web extending outwardly at each side of said web to engage said grooves at each side thereof in said enlarged dowel end portions securing said last mentioned end portions in said bores of said second mentioned butt place, and said end portions are rotatable in said bores of said second mentioned butt plate.

2. The structure of claim 1, wherein said extneded end portions of said dowels having said bores off center axillary of said dowels in being seated upon said bosses whereby rotation of said dowels varies the spacing between them.

3. The structure of claim 1, wherein said dowels with said first mentioned bores each have a plurality of annular grooves thereabout, and O-rings disposed selectively about said grooves project outwardly therof to frictionally engage the first mentioned bores thereabout.

* * * * *